United States Patent [19]

Fogarty et al.

[11] 4,411,249

[45] Oct. 25, 1983

[54] TOY GLIDER WITH PNEUMATIC LAUNCHER

[76] Inventors: Bonnie R. Fogarty; A. Edward Fogarty, both of 3513 School Ave., Sarasota, Fla. 33579; Ralph Nowak, 22 Roosevelt Ave., Marblehead, Mass. 01945; Jack S. Lovewell, 37 Central St., Peabody, Mass. 01960

[21] Appl. No.: 382,695

[22] Filed: May 27, 1982

[51] Int. Cl.[3] ..... F41B 11/00

[52] U.S. Cl. ..... 124/64; 46/44; 46/81

[58] Field of Search ..... 124/64, 62; 46/79, 81, 46/44, 74 B

[56] References Cited

U.S. PATENT DOCUMENTS

| | | | |
|---|---|---|---|
| 2,991,782 | 7/1961 | Ayala | 46/74 B |
| 2,993,297 | 7/1961 | Bednar et al. | 46/81 |
| 4,076,006 | 2/1978 | Breslow et al. | 124/64 |

*Primary Examiner*—Richard T. Stouffer
*Assistant Examiner*—William H. Honaker
*Attorney, Agent, or Firm*—Benjamin P. Reese, II

[57] ABSTRACT

A toy glider comprising a projectile and a pneumatic launcher configured essentially as a bracelet for wearing on the user's wrist. The pneumatic launcher comprises an essentially bracelet-shaped, flexible conduit and an open-ended launching tube having one of its ends in fluid communication with the flexible conduit. The flexible conduit has an integrally formed air bulb which is positionable for concealment in the palm of the user's hand when the flexible conduit is positioned around the user's wrist. The projectile comprises a wing fastened to a flight tube which is moveably positionable on the launching tube of the pneumatic launcher. The wing is fastened to the flight tube by a pair of integrally formed straps which encircle the flight tube and a plurality of integrally formed fingers which are folded into one end of the flight tube and restrained by an end plug.

10 Claims, 6 Drawing Figures

TOY GLIDER WITH PNEUMATIC LAUNCHER

BACKGROUND OF THE INVENTION

This invention relates generally to toy gliders comprising projectiles and pneumatic launchers, and particularly, to such a toy glider having its pneumatic launcher configured essentially as a bracelet.

Various toy gliders, toy rockets and similar toy devices comprising projectiles and pneumatic launchers are provided by the prior art. In general, such prior art toy devices utilize a pneumatic launcher having a conventional air bulb or bellows in fluid communication with a launching tube and a projectile having a receiving recess or other receiving means positionable over the launching tube to receive compressed air. Most prior art toy gliders, toy rockets and similar toy devices of this general type are designed for either hand-held operation or floor or table top operation. An exemplary prior art toy rocket which utilizes a pneumatic launcher having a generally rectangular air bulb mounted on a flat base and adapted to withstand a sudden impact from the user's hand or foot is disclosed in U.S. Pat. No. 4,076,006, issued to Breslow, et al., for a "Toy Rocket with Pneumatic Launcher".

While many of the various prior art toy gliders, toy rockets and similar toy devices comprising projectiles and pneumatic launchers are satisfactory for their intended use, it is desirable to have such a toy device which encourages a child to make greater use of her or his imagination during play activities than would be the case if he or she were engaged in play activities with most prior art toy devices of this general type. It is believed that a toy glider of this general type having a pneumatic launcher configured essentially as a bracelet to be worn around a child's wrist would encourage the wearing child to make substantially greater use of his or her imagination during play activities. It is further believed that a child wearing such a pneumatic launcher on her or his wrist would be encouraged to make still greater use of her or his imagination during play activities if the pneumatic launcher is configured such that its air bulb or bellows can be positioned in the palm of her or his hand in a manner which conceals the air bulb or bellows from the view of others during its operation and use.

SUMMARY OF THE INVENTION

The present invention provides a toy glider comprising a projectile and a pneumatic launcher. More particularly, the present invention provides such a toy glider having its pneumatic launcher configured essentially as a bracelet which can be worn on the user's wrist with its air bulb concealed from view in the palm of his or her hand.

The pneumatic launcher of the toy glider of the present invention comprises an essentially bracelet-shaped, flexible conduit having an integrally formed air bulb, and an open-ended launching tube having one of its ends in fluid communication with the flexible conduit. In the preferred embodiment, the flexible conduit is a one piece hollow body formed by blow molding a rubberized plastic material. The launching tube is preferably formed from a hard plastic material and has means for frictionally holding the projectile in position prior to launching. Both the flexible conduit and the launching tube are impervious with an air tight seal between them.

The projectile of the toy glider of the present invention comprises a flight tube having one open end and one closed end, and a wing fastened to the flight tube. The flight tube is moveably positionable on the launching tube of the pneumatic launcher to accept compressed air for launching. In the preferred embodiment, the wing is formed from a semi-rigid, felt-like, fiberous material and has a pair of integrally formed parallel straps and a plurality of integrally formed foldable fingers. The flight tube is preferably a semi-rigid, thin-walled, plastic tube which is open on both ends prior to assembly of the projectile. The projectile is assembled by inserting the flight tube through the strap openings in the wing and folding the fingers into an open end of the flight tube. An end plug is then inserted in the same open end of the flight tube to restrain the fingers.

These and many other advantages, features and objects of the present invention will be apparent from the following brief description of the drawings, detailed description of the preferred embodiment and claims, and the accompanying drawings.

DETAILED DESCRIPTION OF THE PREFERRED EMBODIMENT

The preferred embodiment of the toy glider of the present invention is illustrated in FIGS. 1–6.

Figure 1:
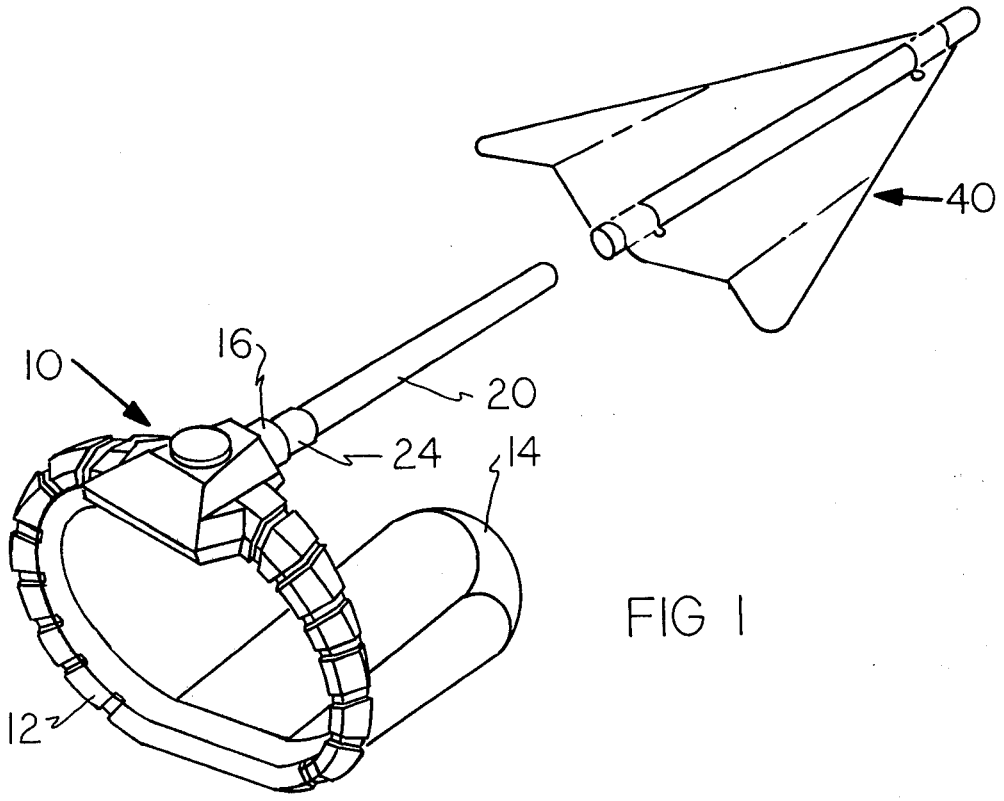
FIG. 1 is a perspective view of one embodiment of the toy glider of the present invention with its projectile illustrated in flight immediately after launching by its pneumatic launcher.
Figure 2:
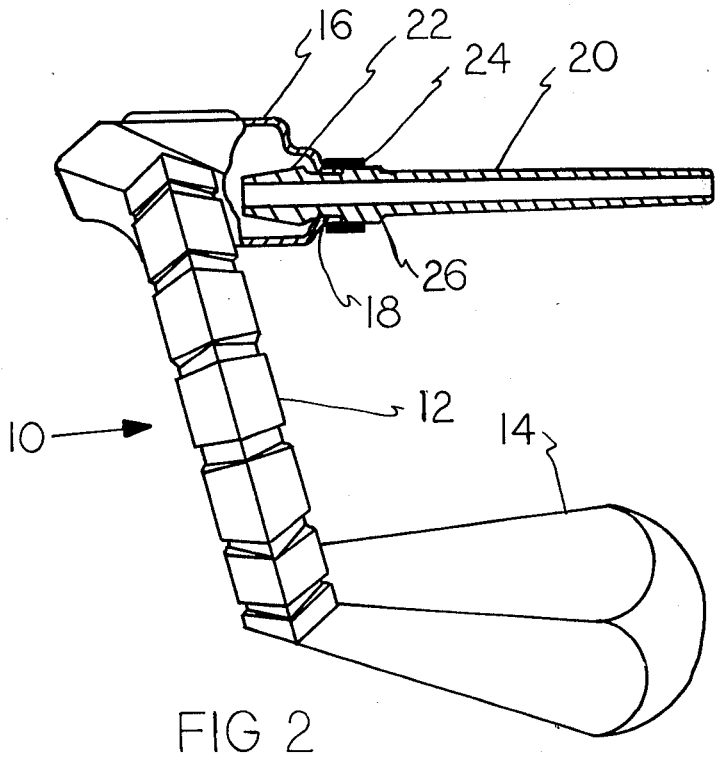
FIG. 2 is a side elevational view, in partial section, further illustrating the pneumatic launcher shown in FIG. 1.
Figure 3:
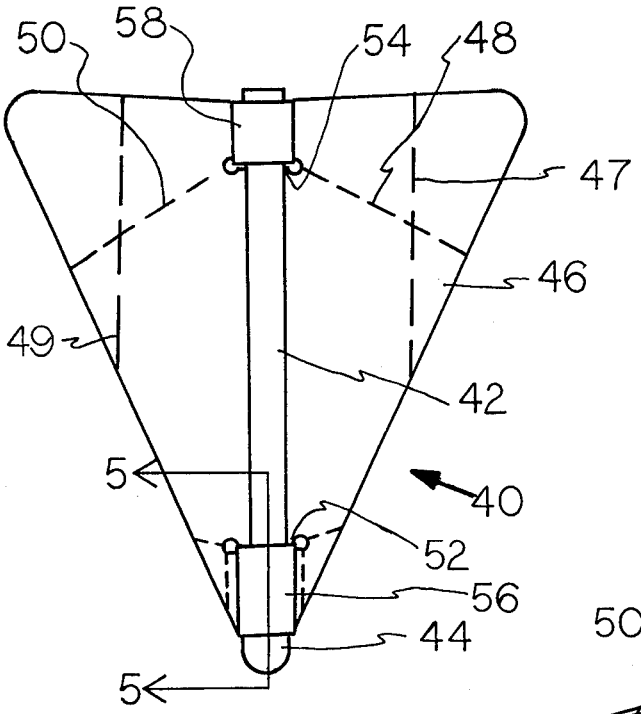
FIG. 3 is a top planar view further illustrating the projectile shown in FIG. 1.

Referring to FIG. 1, the toy glider which is illustrated comprises a pneumatic launcher 10 and a projectile 40. As best illustrated in FIG. 2, the pneumatic launcher 10 consists essentially of a generally bracelet-shaped, impervious, flexible conduit 12 having an integrally formed air bulb 14 and an integrally formed compressed air mixing chamber 16, and an open-ended, impervious rigid launching tube 20 having one of its ends in fluid communication with the mixing chamber 16. Preferably, the launching tube 20 is provided with a first flange 22 and a second flange 24 on its end in fluid communication with the chamber 16 of the conduit 12 so that an air-tight seal can be formed between the mixing chamber 16 and the launching tube 20 by force fitting the first flange 22 of the launching tube 20 in the bore of an open tubular protrusion 18 of the mixing chamber 16 and force fitting a sealing ring 19 over the second flange 24 and the tubular protrusion 18.

Both the flexible conduit 12 and rigid launching tube 20 can be fabricated from various conventional materials by various conventional means. However, it is preferable to fabricate the flexible conduit 12, including its air bulb 14 and mixing chamber 16, by blow molding a suitable rubberized plastic material as a single, hollow body having only one opening through its wall, i.e. the bore of the tubular protrusion 18 of the mixing chamber 16 for receipt of the launching tube 20. And, it is preferable to fabricate the launching tube 20 from a suitable hard plastic material by an injection molding process.

As best illustrated in FIGS. 3–6, the projectile 40 consists essentially of an open-ended, impervious, semi-rigid flight tube 42, an end plug 44 which closes one end of the flight tube 42, and a semi-rigid wing 46 which is attached to the flight tube 42. The flight tube 42, end plug 44 and wing 46 can be fabricated from various conventional materials by various conventional means. However, to simplify final assembly of the projectile 40, it is preferable to fabricate the wing 46 by cutting a generally triangular piece from a sheet of a suitable felt-like, fiberous material, perforating the triangular piece along its longitudinal axis and appropriately located fold lines (such as lines 47, 48, 49 and 50), cutting a pair of parallel openings 52 and 54 through the triangular piece to form a pair of parallel straps 56 and 58 perpendicular to its longitudinal axis, and cutting the vertex area of the triangular piece to form a plurality of foldable fingers 60. Preferably, the flight tube 42 is fabricated by cutting commercially available semi-rigid, thin-walled, plastic tubing to the desired length. The end plug 44 is preferably machined from suitable hard plastic rod stock.

Figure 4:
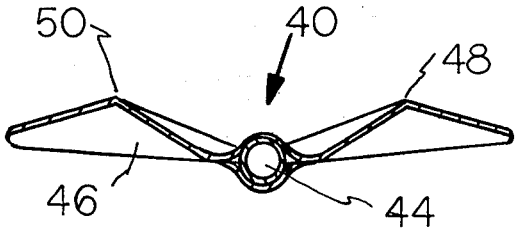
FIG. 4 is a front elevational view further illustrating the projectile shown in FIG. 1 and FIG. 3.
Figure 5:
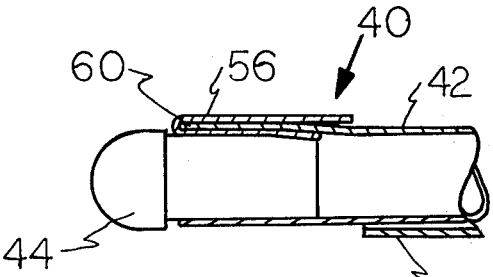
FIG. 5 is a vertical partial sectional view, on an enlarged scale, taken generally along line 5—5 in FIG. 3.
Figure 6:
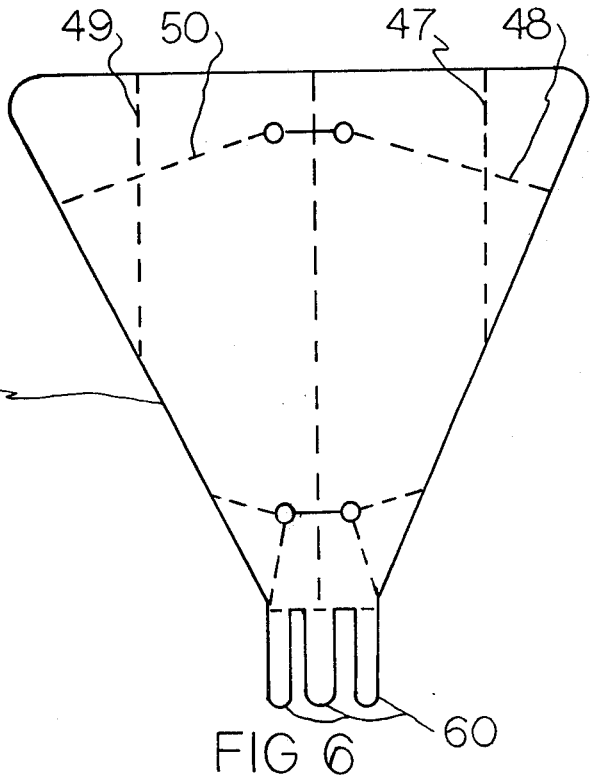
FIG. 6 is a top planar view illustrating the wing of the projectile in FIG. 1 and FIG. 3 prior to assembly of the projectile.

Prior to assembly of the projectile 40, the wing 46 is folded along its perforated longitudinal axis and perforated fold lines 47, 48, 49 and 50 to aerodynamically shape the wing 46 as illustrated in FIGS. 1 and 4. While the wing shape illustrated in FIGS. 1 and 4 has proved to be satisfactory for stable flight of the projectile 40, it will be appreciated by those skilled in aerodynamic design that other wing shapes can be used. It will also be readily appreciated that other wing shapes can be provided for the wing 46 by adding, deleting or relocating perforated fold lines during the fabrication process described above. And, of course, geometrical forms other than triangles can be used for the wing 46.

The projectile 40 is assembled by inserting the flight tube 42 through the openings 52 and 54 in the wing 46 and positioning the flight tube 42 along the longitudinal axis of the wing 46 such that the wing 46 is partially fastened to the flight tube 42 by the parallel straps 56 and 58. Next, the fingers 60 extending from the strap 56 near the vertex of the wing 46 are folded into the adjacent open end of the flight tube 42. The end plug 44 is then inserted in said open end of the flight tube 42 to restrain the fingers 60 in the interior of the flight tube 42, and, thereby, further fasten the wing 46 to the flight tube 42.

Having described the structure of the preferred embodiment of the toy glider of the present invention, its use will now be described. As best illustrated in FIG. 1, the user of the toy glider of the present invention places the pneumatic launcher 10 on one of his or her wrists with the free end of the launching tube 20 pointing away from his or her body by inserting his or her hand through the opening circumscribed by the bracelet-shaped, flexible conduit 12. With the free end of the launching tube 20 pointed away from the user's body in this manner, the air bulb 14 of the pneumatic launcher 10 will be positioned in the palm of the user's hand. The user of the toy glider next positions the projectile 40 on the launching tube 20. This is accomplished by placing the open end of the flight tube 42 on the free end of the launching tube 20 and sliding the flight tube 42 toward the flanged end of the launching tube 20 until the open end of the flight tube 42 expands and engages the taper 26 of the flange 24 to form an air tight seal between the launching tube 20 and the flight tube 42.

When the open end of the flight tube 42 engages the taper 26 of the flange 24, the frictional force between the interior surface of the flight tube 42 and the surface of the taper 26 is sufficient, even when the free end of the launching tube 20 is tilted downward, to hold the projectile 40 in position on the launching tube 20 until the projectile 40 is launched. The user launches the projectile 40 by rapidly and firmly squeezing the air bulb 14 with her or his hand to force two separate streams of compressed air through the flexible conduit 12. The separate streams of compressed air join in the mixing chamber 16, flow through the launching tube 20, and discharge into the interior of the flight tube 42.

The compressed air discharged through the launching tube 20 into the flight tube 42 impinges on the rear surface of the end plug 44, and, when the resulting accelerational force exceeds the frictional force between the taper 26 and expanded end of the flight tube 42, the air tight seal between the launching tube 20 and the flight tube 42 breaks with a loud popping sound as the projectile 40 is launched for its gliding flight. Once the projectile 40 is launched, the inertia from the weight of its flight tube 42 and its end plug 44 sustains its gliding flight. And, of course, its wing 46 guides and controls its gliding flight.

While the present invention has been disclosed in connection with its preferred embodiment, it should be understood that there may be other embodiments which fall within the scope and spirit of the invention as defined by the claims.

We claim:

1. A toy glider and launcher therefor, comprising:

(a) a pneumatic launcher, including a closed loop flexible conduit having an integrally formed air bulb in fluid communication therewith, said air bulb being positionable for concealment in the palm of the user's hand when said flexible conduit is positioned around the user's wrist, and an open-ended launching tube for holding a projectile prior to launching, said launching tube being in fluid communication with said flexible conduit and said air bulb; and (b) a projectile, including a flight tube having one open end and one closed end, said flight tube being moveably positionable on said launching tube of said pneumatic launcher, and a wing fastened to said flight tube.

2. A toy glider as recited in claim 1 wherein said flexible conduit has an integrally formed compressed air mixing chamber.

3. A toy glider as recited in claim 2, wherein said launching tube is in fluid communication with said mixing chamber of said flexible conduit.

4. A toy glider as recited in claim 3, wherein said launching tube has a first flange and a second flange on its end in fluid communication with said mixing chamber, said first flange of said launching tube being force fitted in the bore of an open tubular protrusion of said mixing chamber and said second flange of said launching tube being positioned exterior to said mixing chamber.

5. A toy glider as recited in claim 4, further comprising a sealing ring fitted over said second flange of said launching tube and said tubular protrusion of said mixing chamber.

6. A toy glider as recited in claim 4 or 5, wherein said second flange of said launching tube has a taper for engaging the interior surface of the open end of said flight tube to form an air-tight seal between said launching tube and said flight tube and to hold said projectile in position on said launching tube prior to launching.

7. A toy glider as recited in claim 1, wherein said wing is fastened to said flight tube by a pair of parallel straps which encircle said flight tube and a plurality of fingers which are folded into one end of said flight tube and restrained by an end plug inserted in the same end of said flight tube, said parallel straps and said fingers being integrally formed with said wing.

8. A toy glider as recited in claim 7, wherein said parallel straps are formed by parallel openings through said wing.

9. A toy glider as recited in claims 1, 7 or 8 wherein said wing is formed from a semi-rigid, fiberous material.

10. A toy glider as recited in claims 1, 7 or 8, wherein said wing is formed from a semi-rigid, fiberous material which has been perforated along pre-selected fold lines so that said wing can be aerodynamically shaped by folding along said fold lines.

* * * * *